United States Patent [19]

Ungemach

[11] Patent Number: 4,600,290

[45] Date of Patent: Jul. 15, 1986

[54] MAGNETIC BRUSH/STATIONARY ELECTRODE DEVELOPMENT SYSTEM

[75] Inventor: Steven R. Ungemach, Pleasanton, Calif.

[73] Assignees: Ricoh Co., Ltd., Tokyo, Japan; Ricoh Systems, Inc., San Jose, Calif.

[21] Appl. No.: 754,914

[22] Filed: Jul. 15, 1985

Related U.S. Application Data

[63] Continuation of Ser. No. 593,486, Mar. 26, 1984, abandoned.

[51] Int. Cl.[4] ..... G03G 15/08

[52] U.S. Cl. ..... 355/3 DD; 355/14 D; 355/15; 118/652; 118/657; 118/655; 430/121; 430/122; 430/125

[58] Field of Search ..... 355/3 DD, 14 D, 3 R, 355/14 R, 15; 430/35, 120, 121, 125, 122; 118/652, 653, 655

[56] References Cited

U.S. PATENT DOCUMENTS

| | | | |
|---|---|---|---|
| 3,472,657 | 10/1969 | Mayer et al. | 355/3 DD X |
| 4,007,707 | 2/1977 | Buchan et al. | 355/3 DD X |
| 4,113,371 | 9/1978 | Fraser et al. | 355/3 DD X |
| 4,131,357 | 12/1978 | Forbes | 355/3 DD |
| 4,264,185 | 4/1981 | Ohta | 355/3 DD X |
| 4,466,728 | 8/1984 | Schlageter et al. | 355/3 DD |

*Primary Examiner*—A. C. Prescott
*Attorney, Agent, or Firm*—Flehr, Hohbach, Test, Albritton & Herbert

[57] ABSTRACT

An electrophotographic copying apparatus is disclosed, including a first rotating cylindrical electrode positioned above the lowest point of rotation of the photoconductive surface and closely adjacent that surface. This first electrode is suitably biased to form a brush of toner which, as the brush rotates with the direction of the travel of the image, develops the image. A second rotating cylindrical electrode is positioned at the low point of travel of the latent image surface; the brush formed on the surface of this electrode as the electrode rotates against the direction of travel of the image, develops the trailing edges of the image. A biased electrode plate extends from the upper electrode to a point near to the lowest electrode. As toner material is supplied to the first rotating electrode, it is carried over the surface of this electrode and flows down through the development path defined by the electrode plate and the rotating drum surface to develop the latent image. A gap is formed between the lower point of the plate and the rotating electrode so that unused carrier may fall away from the surface of the rotating drum and into the sump which is defined in the bottom of the housing. A third roller is located further along the development path and above the second roller and rotates against the direction of travel of the photoconductive surface. This roller is used primarily for cleaning. A second plate electrode extends from this third roller substantially down to a point closely adjacent the second rotating electrode. Toner material flows over the surface of the third electrode and down through this gap defined by the second plate electrode and the moving latent image surface. The development in this region supplements the development action of the second roller.

8 Claims, 1 Drawing Figure

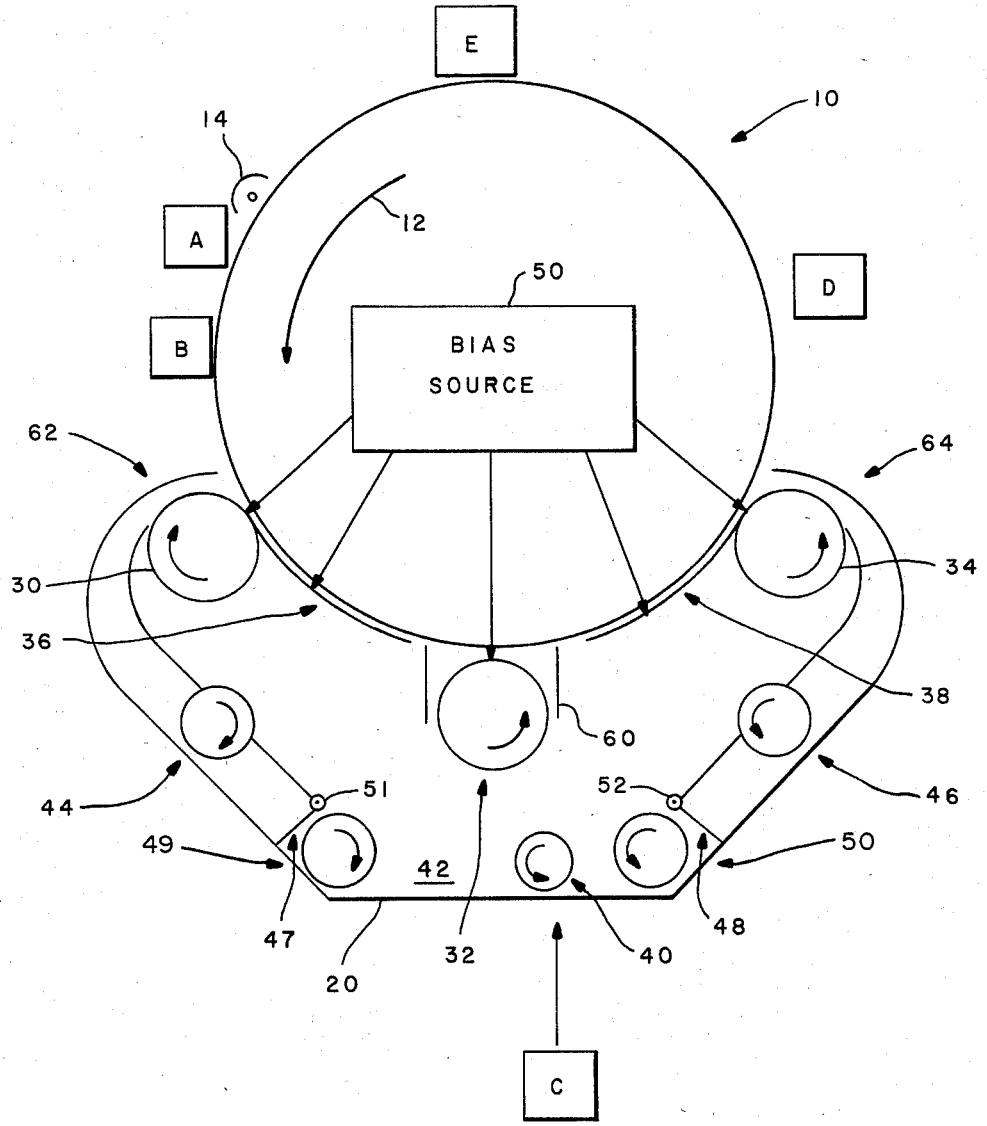
E
10
14
12
A
50
D
B
BIAS
SOURCE
62
64
30
34
36
38
60
44
51
52
46
49
42
50
47
48
20
32
40
C

MAGNETIC BRUSH/STATIONARY ELECTRODE DEVELOPMENT SYSTEM

This application is a continuation of U.S. application, Ser. No. 593,486, filed Mar. 26, 1984 now abandoned.

This invention relates generally to electrophotographic copying apparatus, and more particularly to an assembly for developing a latent electrostatic image formed on the outer surface of a developing drum.

The present invention is especially useful in a known type of electrophotographic copying apparatus which includes a rotatable drum having a photosensitive outer circumferential surface, and means for rotating the drum so that this outer surface defines a fixed annular path of movement. The apparatus produces copies from a given electrostatic latent image corresponding to the information to be copied. The latent image is represented by a pattern of voltage gradients on the surface of the drum. The latent image is developed by means of charged toner particles applied to the image bearing surface; the applied toner is transferred from the drum to a blank sheet for transforming the latter to the desired copy.

Considering the formation of the latent image more particularly, the insulating surface of the photoconductive drum is first given a uniform electrostatic charge. the charged surface is exposed to a light pattern conforming to the information to be reproduced. During exposure, the charge on the insulating surface is dissipated in proportion to the lightness of the area to be copied. Thus, after exposure is completed, a pattern of electrical potential or a latent image remains on the insulating surface which can be developed by applying toner to the surface. As the toner comes into contact with the surface, being charged to an opposite potential from the latent image, it is attracted to the areas of the surface of higher electrical potential to produce a developed image which can be transferred to paper or the like.

One known development technique by which toner can be applied to the insulating surface is cascade development. Two-component developer consists of a mixture of toner particles and carrier material, which as the name applies carries the toner in a controlled manner from place to place in the development housing. It is brought to an elevated position adjacent the insulating surface, and released so that it flows or cascades past the surface bearing the latent image.

Typically, the carrier material is chosen so that it is remotely located from the toner material in the triboelectric series; when the two are mixed, the charges generated on each due to triboelectrification which makes each attractive to the other. The triboelectrification causes many toner particles to adhere to each carrier bead. When the developer is cascaded through the development zone, adjacent or over the surface of the drum, the toner particles are separated from the carrier material and attracted to the charged portions of the insulating surface due to the impact of the developer against the surface and strong forces of attraction on the toner particles by electrostatic forces on the surface. After flowing through the development zone, the carrier material and any remaining toner particles are mixed with additional toner particles, raised to the elevated position and again cascaded over the plate.

It is an objective of the present invention to provide an improved apparatus for developing latent electrostatic images.

Another object of the present invention is to provide improved apparatus for cascade development.

A number of problems exist in known cascade development apparatus. For example, the apparatus may result in a relatively intermittent flow of developer cascading across the surface. Alternatively, the developer flow if sustained too long may result in development of some of the background area which must be maintained light for proper contrast. Some prior efforts in this area are represented in U.S. Pat. No. 3,641,980 (Bickmore) which includes a plate located nearly adjacent to the charged surface, and at least two electrodes located near the plate, and rotating both in the direction of movement of the latent image to cause developer to flow over the surface. A later effort is disclosed in a patent to Brit, U.S. Pat. No. 3,670,700, which shows a plate extending a significant distance around the rotating photoconductive drum; in this patent, material flows in a direction opposite the rotation of the drum; cooperating developer supply electrodes rotate in the direction of material flow.

It is also known to use magnetic brush development of the latent image. For example, in applicant's U.S. patent application Ser. No. 199,096, filed Oct. 20, 1980 now U.S. Pat. No. 4,384,784 and incorporated herein by reference, two rotating electrodes are utilized; the uppermost rotates against the rotation of the drum, and the lower one rotates with the direction of the drum. They are biased to attract toner particles to the surface of the circumferential electrode, forming a "brush." As the image rotates past the rotating electrodes, the toner material is brushed against the surface, and the toner transferred to the charged areas of the surface.

It is a specific objective of the present invention to provide a unique combination of the rotating electrodes and biased developer plate electrodes to maximize development of the latent image and contrast of the dark areas of the image with light areas of the image.

The above and other objectives of the present invention are achieved by an apparatus including a first rotating cylindrical electrode positioned above the lowest point of rotation of the photoconductive surface and closely adjacent that surface. This first electrode is suitably biased to form a brush of toner which, as the brush rotates with the direction of the travel of the image, develops the image. A second rotating cylindrical electrode is positioned at the low point of travel of the latent image surface; the brush formed on the surface of this electrode as the electrode rotates against the direction of travel of the image, develops the trailing edges of the image. A biased electrode plate extends from the upper electrode to a point near to the lowest electrode. As toner material is supplied to the first rotating electrode, it is carried over the surface of this electrode and flows down through the development path defined by the electrode plate and the rotating drum surface to develop the latent image.

A gap is formed between the lower point of the plate and the rotating electrode so that unused carrier may fall away from the surface of the rotating drum and into the sump which is defined in the bottom of the housing. A third roller is located further along the development path and above the second roller and rotates against the direction of travel of the photoconductive surface. This roller is used primarily for cleaning. A second plate electrode extends from this third roller substantially down to a point closely adjacent the second rotating electrode. Toner material flows over the surface of the third electrode and down through this gap defined by the second plate electrode and the moving latent image surface. The development in this region supplements the development action of the second roller.

For better understanding of the invention as well as other objects and features thereof, references should be made to the following detailed description of the invention to be read in conjunction with the single drawing which is a schematic side elevation of an automatic xerographic machine utilizing the present invention.

The general apparatus in which the instant invention is embodied comprises an automatic electrophotographic copying machine employing a drum shaped photoconductive plate 10. The drum is mounted on a shaft journaled in the machine frame (not shown) and is rotated in the direction indicated by the arrow 12 by a motor which causes the drum surface to sequentially pass through a plurality of processing stations.

For purposes of the present invention, the several processing stations positioned in the path of movement of the drum 10 as shown in FIG. 1 may be described functionally as follows:

A. A charging station which is positioned at a corona generating device 14 for placing a uniform electrostatic charge on the photoconductive layer of the drum surface as the drum is turned in the direction indicated by arrow 12.

B. An exposure station at which a light irradiation pattern of the original document to be reproduced is projected onto the drum surface, thereby dissipating parts of the charge found thereon in the areas exposed to form a latent electrostatic image of the original document.

C. A developing station which is the particular subject of this invention and including a housing 20 in which two-component developer material utilizing charged toner particles is delivered to the development zone or zones defined by the rotating electrode and biased plate electrode.

D. A transfer station at which the xerographic powder image is electrostatically transferred from the drum surface to a sheet of final support material; and E. A drum cleaning and discharge station at which the drum surface is exposed to a cleaning corona and contacted by a doctor blade or other cleaning means to remove residual toner particles which may remain thereon after the transfer operation and where the drum is sected to further processing to substantially completely discharge any residual electrostatic charge remaining thereon.

Referring now more particularly to the developing assembly 20, it essentially includes a series of conductive rotating cylindrical electrodes 30, 32, 34, separated by biased plate electrodes 36, 38. The electrodes and plates are supported in close parallel relationship to a moving xerographic drum surface 10 to form an enclosed flow path for the developing material. The developing material which in a preferred embodiment comprises a two-component mixture of toner particles and carrier is mixed together by a mixing device 40 located in the bottom of a sump 42. The material is carried up to the flow path by rotating feed rollers 44, 46, 49, 50. The material is fed past hinged baffles 47, 48 by feed rollers 49, 50. The baffles 47, 48 are hinged or pivoted at points 51, 52, to allow the developer to pass while preventing backflow of the developer. In other words, the developer moves up the sides of the sump as propelled by lower transport rolls 44, 46. The plates 47, 48 swing upward and function as flapper valves as the developer moves past.

The material which is fed up the left hand side of the housing 20 to the magnetic brush roller 30 is the first to be brought into contact with the latent image on the photoconductive surface. Projections 62, 64 in the housing 20 control the thickness of material on cylindrical electrodes 30, 34. Rollers 30 and 32 and if desired roller 34 are suitably biased to attract toner thereto to form a magnetic brush of material which is brushed against the surface of the rotating drum as is well known in the art.

Appropriate biasing for these rollers 20, 32, 34 and the plates 36, 38 is provided by a bias source 50 which is only generally illustrated here; connecting such a bias source to rollers in an electrophotographic device is already well understood. The roller 30 is rotating with the latent image and the toner forming the magnetic brush is used to develop the image. After leaving the roller 30, much of the carrier (still carrying the toner particles), falls through the channel defined by electrode plate 36 and the drum surface. Since the effective dielectric constant of the gap formed by the electrode 36 and the drum is lower than that of the gap between the roller 30 and the drum, development in the gap between the electrode and the roller can be controlled by varying the voltage applied from the bias source 50; thus the carrier action within this development gap supplements the development accomplished by roller 30. For example, by placing the development electrode at a potential between the image and background potentials, electrode 36 acts as a self regulating device capable of enhancing image development while at the same time cleaning or scavenging random background development from the drum surface by the action of the carrier particles coming into contact with the image in the gap.

An opening does exist between the end of the plate electrode 36 and rotating electrode 32 which is rotating against the direction of movement of the latent image.

Most of the toner particles, i.e, carrier with attracted toner, will fall through this gap back into the sump to be remixed and re-fed by rollers 44, 46.

The roller 32 also forms a magnetic brush which rotates against the direction of travel of the latent image. It has been found that a brush so positioned will develop the trailing edges of the latent image which are otherwise frequently not well developed in this type of system. A doctor blade 60 controls material thickness on the roller 32.

It should be noted that material velocity of the carrier and toner moving past the rotating electrode 30 and electrode plate 32 is controlled primarily by the speed of roller 30 and the surface roughness of the electrode plate 36.

A third rotating cylindrical electrode 34 is also provided, located above the second rotating electrode in the developing system. This rotating electrode 34 is rotating against the image and is biased to provide for carrier trapping, i.e., removal of carriers which are rotating with the surface of the drum on the image and are to be removed. Some developing material may be forwarded by developing rollers 46 to flow over the top of roller 34. This material flows into the developing gap which is now defined by plate electrode 38 and latent image surface 10. Development may also occur in this region, depending on the bias source applied to the plate, and will supplement the developing action of roller 32.

Alternatively, by control of the bias source 50, the electrode plate 38 may be appropriately biased to primarily serve as a cleaning function. If cleaning is to be the primary function of the second plate electrode, then this electrode can be shorter than the other plate electrode 36. This first plate electrode 36 must be of sufficient length to provide efficient development; its upper extent must be very close to the surface of the rotating electrode 30 in order to effectively clean a portion of the magnetic brush off the electrode 30 and cause cascade of the developing material down through the gap the plate defines. A similar function may be accomplished by plate electrode 38 by setting its upper extent close to the rotating electrode 34. In either case, a gap is left between the lower end of the plate electrode and the center lowermost electrode 32 in order to allow a space for the cascaded development carrier material to fall back into the sump 42.

Other variations and modifications of the present invention may become apparent to one of skill in the art who has reviewed the subject invention disclosure. Therefore, the scope of the present invention is to be limited only by the following claims.

What is claimed:

1. In an electrophotographic copying apparatus for developing electrostatic latent images on a photosensitive outer surface of a rotating developing drum, the drum being moved through a development zone in contact with a cascading flow of two-component developer material to develop the latent electrostatic image, the apparatus including:

(a) a sump containing a supply of developing material including electrically charged toner particles displaying the opposite electrostatic polarity of said image, (b) a first cylindrical electrode supported for rotation in the direction of movement of said surface;

(c) a first bias supply for forming a brush on the surface of said electrode for developing said image, said first electrode being located close enough to the surface of the drum to brush the surface and thereby develop said images, (d) a second cylindrical electrode supported for rotation opposite the direction of movement of said surface, (e) a second bias supply means for forming a brush of toner material on the surface of said second electrode for developing the images, said second electrode being located sufficiently close to said surface of said drum to brush the surface and develop the trailing edges of said images, (f) a plate electrode extending parallel to said drum between said first and second electrodes, (g) a third bias supply for biasing said plate electrode to supplement the development of said images, and (h) means for directing a supply of toner material over said first cylindrical electrode and along a path between said plate electrode and said drum to develop said latent images.

2. Apparatus as claimed in claim 1 wherein said plate electrode extends from a position closely adjacent said first electrode to a point spaced from said second electrode, the spacing between the plate electrode and the second cylindrical electrode defining an opening for allowing the toner to fall into the sump.

3. Apparatus as claimed in claim 2 further comprising a plate adjacent the space between the plate and second cylindrical electrodes to limit the amount of toner reaching the second electrode along said toner path.

4. An assembly as claimed in claim 3 further comprising a doctor blade adjacent the second electrode for limiting the size of the brush formed on the electrode.

5. An assembly as claimed in claim 2 comprising a third cylindrical electrode rotating against the direction of movement of said photoconductor surface.

6. An assembly as claimed in claim 5 further comprising means for applying a bias potential to said third roller relative to the background potential of said latent image to clean said photoconductive surface.

7. An assembly as claimed in claim 6 further comprising a second plate electrode located adjacent said moving surface between said second and third cylindrical electrodes, said electrode being biased to facilitate cleaning of said drum.

8. Apparatus as claimed in claim 7 wherein said second electrode is of lesser extent than said first electrode.

* * * * *